US005402574A

United States Patent [19]

Milner

[11] Patent Number: 5,402,574

[45] Date of Patent: Apr. 4, 1995

[54] SHAVING APPARATUS

[76] Inventor: Joshua P. Milner, 24 Timber Ave., Opelika, Ala. 36801

[21] Appl. No.: 246,756

[22] Filed: May 20, 1994

[51] Int. Cl.[6] ..... B26B 21/22

[52] U.S. Cl. ..... 30/41.5; 30/50; 30/89

[58] Field of Search ..... 30/41, 41.5, 47–50, 30/86, 89

[56] References Cited

U.S. PATENT DOCUMENTS

| | | | |
|---|---|---|---|
| 1,107,538 | 8/1914 | McDermott . | |
| 2,691,217 | 10/1954 | Clark | 30/50 |
| 4,205,441 | 6/1980 | Turner | 30/41.5 |
| 4,228,586 | 10/1980 | Thierry | 30/41 |
| 4,378,633 | 4/1983 | Jacobson | 30/50 X |
| 4,587,729 | 5/1986 | Jacobson | 30/41 |
| 4,621,424 | 11/1986 | Jacobson | 30/41 |
| 4,955,136 | 9/1990 | Diaz-Rivera | 30/50 X |
| 5,067,238 | 11/1991 | Miller et al. | 30/50 X |
| 5,072,512 | 12/1991 | Noujaim | 30/41.5 |
| 5,074,042 | 12/1991 | Althaus et al. | 30/50 |
| 5,168,628 | 12/1992 | Mock et al. | 30/41 |

*Primary Examiner*—Douglas D. Watts
*Attorney, Agent, or Firm*—Rhodes & Ascolillo

[57] ABSTRACT

The shaver head has a chamber that has an enclosing wall. An upper blade port and a lower blade port is cut or formed through the enclosing wall. A first pair of upper tab guides and a second pair of upper tab guides is formed on the enclosing wall. An upper support member and a lower support member is attached to the enclosing wall. Three upper spring member retaining mounts are on the upper support member and three lower spring member retaining mounts are on the lower support member. An upper razor blade in the chamber partially extends through the upper blade port and a lower razor blade in the chamber partially extends through the lower blade port. The first pair of tabs, on a right side the upper razor blade, are slidingly engaged in the first pair of the upper tab guides. The second pair of tabs, on a left side of the upper razor blade, are slidingly engaged in the second pair of the upper tab guides. A first pair of tabs, on a right side the lower razor blade, is slidingly engaged in the first pair of the lower tab guides. A second pair of tabs, on a left side of the lower razor blade, is slidingly engaged in the second pair of the lower tab guides. An upper spring is in each of the upper spring retaining mounts and a lower spring is in each-of the lower spring retaining mounts. The springs abut the blades and bias the blades away from the support members. The shaving apparatus has a flexible handle to allow the shaver head to move. The flexible handle has a longitudinal passage therethrough to allow the flow of water through the handle to the shaver head.

3 Claims, 5 Drawing Sheets

SHAVING APPARATUS

BACKGROUND OF THE INVENTION

1. Field of the Invention

This invention relates to a shaving apparatus in general and to a shaving head having spring-loaded floating blades, a flexible handle and a flushing feature in particular.

2. Description of the Related Art

Many attempts have been made to increase the shaving comfort of the user of a razor. Springs have been involved in several pieces of related art to varying degrees of success.

U.S. Pat. No. 1,107,538 to T. E. McDermott on Aug. 18, 1914 for a Safety Razor describes a razor having springs engaged with a blade-bed to provide a constant yielding pressure on the blade to reduce vibration while shaving. This is an early razor of the type using replaceable blades secured inbetween two beds designed to hold the razor securely. This arrangement tended to allow the blade to vibrate as the blade traveled across the surface to be shaved due to the tension placed on the blades by the beds. This device appears to keep the user from tightening the beds too tight.

U.S. Pat. No. 2,691,2 17 to T. P. Clark on Oct. 12, 1954 for a Razor and Blade Holder shows adjustable spaced parallel blade holders which have spring-loaded blade envelopes thereon to hold the blade in place. This is also one of the older threadingly adjustable replaceable blade holders. This holder allows the user to vary the pitch of the blade. The spring assists the user in positioning the blade in the holder.

U.S. Pat. No. 4,228,586 to T. T. Thierry on Oct. 21, 1980 for a Shaving Apparatus describes a razor handle capable of being attached, via a flexible hose, to a faucet. Water may then flow through the handle and through the razor head thereby rinsing the blades of shaving debris. This device has narrow blades placed across the face of the shaver and the water is forced out between the narrow blades.

U.S. Pat. No. 5,074,042 to W. Althaus, et al., on Dec. 24, 1991 shows a blade block that is free to swivel against a spring biasing force about a swivelling axis. The spring keeps the blade block in an optimal position for safety.

None of the above devices solve the problem of providing a better shave in the manner the present invention does utilizing floating blades and a flexible handle together.

SUMMARY OF THE INVENTION

Improving the comfort of shaving has always been on the minds of men and women. Difficulties that arise during shaving can be traumatic in the early morning hours and always seem to appear when a person is rushed. The present shaving apparatus is designed to reduce some of the discomforts of shaving rough and/or irregular surfaces.

In a first aspect of the present invention, a shaving apparatus is shown that has a shaver head and a handle. The shaver head has a chamber with an enclosing wall. A blade port is formed into or is cut through the enclosing wall. There is first pair of tab guides formed on or attached to the enclosing wall. There is also a second pair of tab guides formed on or attached to the enclosing wall. A support member is attached to the enclosing wall. There is a biasing member retaining mount on the support member. There is a razor blade in the chamber. A first pair of tabs is attached on a right side the razor blade and a second pair of tabs is attached on a left side of the razor blade. There is a biasing member in the biasing member retaining mount. The biasing member abuts the razor blade and biases the razor blade away from the support member. There is a handle port in the enclosing wall. The shaving apparatus has a handle. The handle has a longitudinal passage therethrough and the handle is attached to the enclosure wall around a periphery of the handle port.

In a second aspect, a shaving apparatus is shown that has a shaver head and a handle. The shaver head has a chamber having an enclosing wall. There is an upper blade port and a lower blade port through and in the enclosing wall. There is a first pair of upper tab guides and a second pair of upper tab guides formed on or attached to the enclosing wall. There is a first pair of lower tab guides and a second pair of lower tab guides formed on or attached to the enclosing wall. An upper support member is attached to the enclosing wall. A lower support member is attached to the enclosing wall. There are three upper biasing member retaining mounts on the upper support member and three lower biasing member retaining mounts on the lower support member. An upper razor blade and a lower razor blade are located in the chamber. There is a first pair of tabs, on a right side of the upper razor blade, engaged in the first pair of the upper tab guides. There is a second pair of tabs, on a left side of the upper razor blade, engaged in the second pair of upper tab guides. A first pair of tabs, on a right side of the lower razor blade, is engaged in a first pair of the lower tab guides and a second pair of tabs, on a left side of the lower razor blade, is engaged in a second pair of the lower tab guides. There is an upper biasing member in each of the upper biasing member retaining mounts. There is a lower biasing member in each of the lower biasing member retaining mounts.-The upper biasing member abuts the upper razor blade and biases the upper razor blade away from the upper support member. The lower biasing member abuts the lower razor blade and biases the lower razor blade away from the lower support member. There is a handle port in the enclosing wall of the chamber. The shaving apparatus has a handle. The handle has a flexible portion (between two nonflexible portions) to allow the shaver head to move back and forth as shown in FIG. 6. The handle has an elongated gripping member that has a flexible portion and a longitudinal passage through the elongated gripping member and the flexible portion. The elongated gripping member is attached to the enclosure wall around a periphery of the handle port.

It is an object of this invention to provide a shaving apparatus that is capable of having the shaving debris flushed away from the blades by running water through the handle and up through the shaving head and past the blades.

It is another object of this invention to provide a shaving apparatus having blades that are biased by springs pushing against the blade and having the blades guided by tabs within the guides to provide smooth controlled back and forth movement of the cutting edge while shaving and to bias the blades in an upward position to facilitate cleaning.

It is another object of this invention to provide a shaving apparatus that has a handle that has a flexible portion to allow the shaver head to move back and forth to follow the contours of the body shaving surfaces and to reduce the stress on the hand and wrist of the user.

DESCRIPTION OF THE PREFERRED EMBODIMENTS

Figure 1:
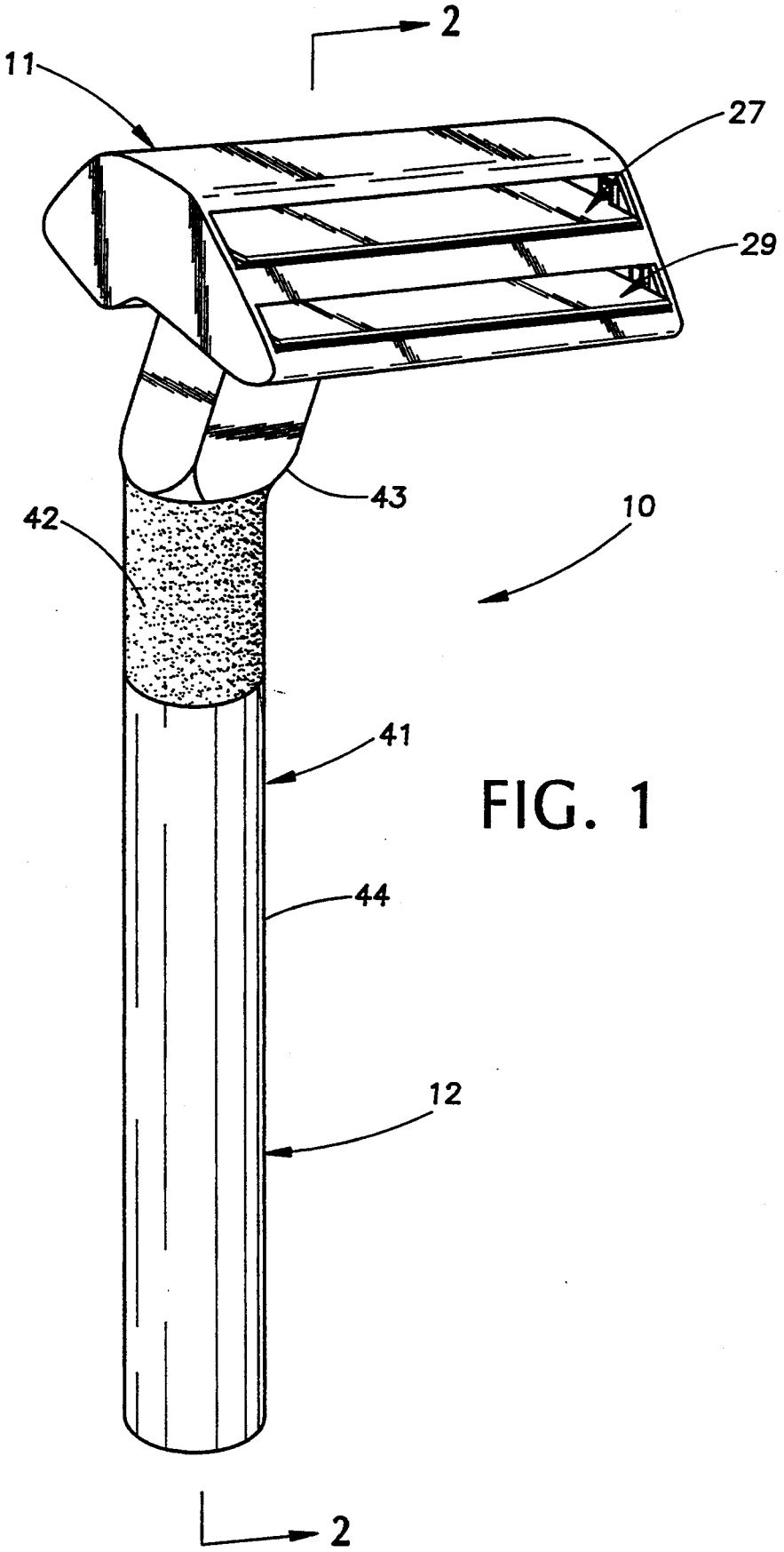
FIG. 1 is a perspective view of the shaving apparatus.
Figure 2:
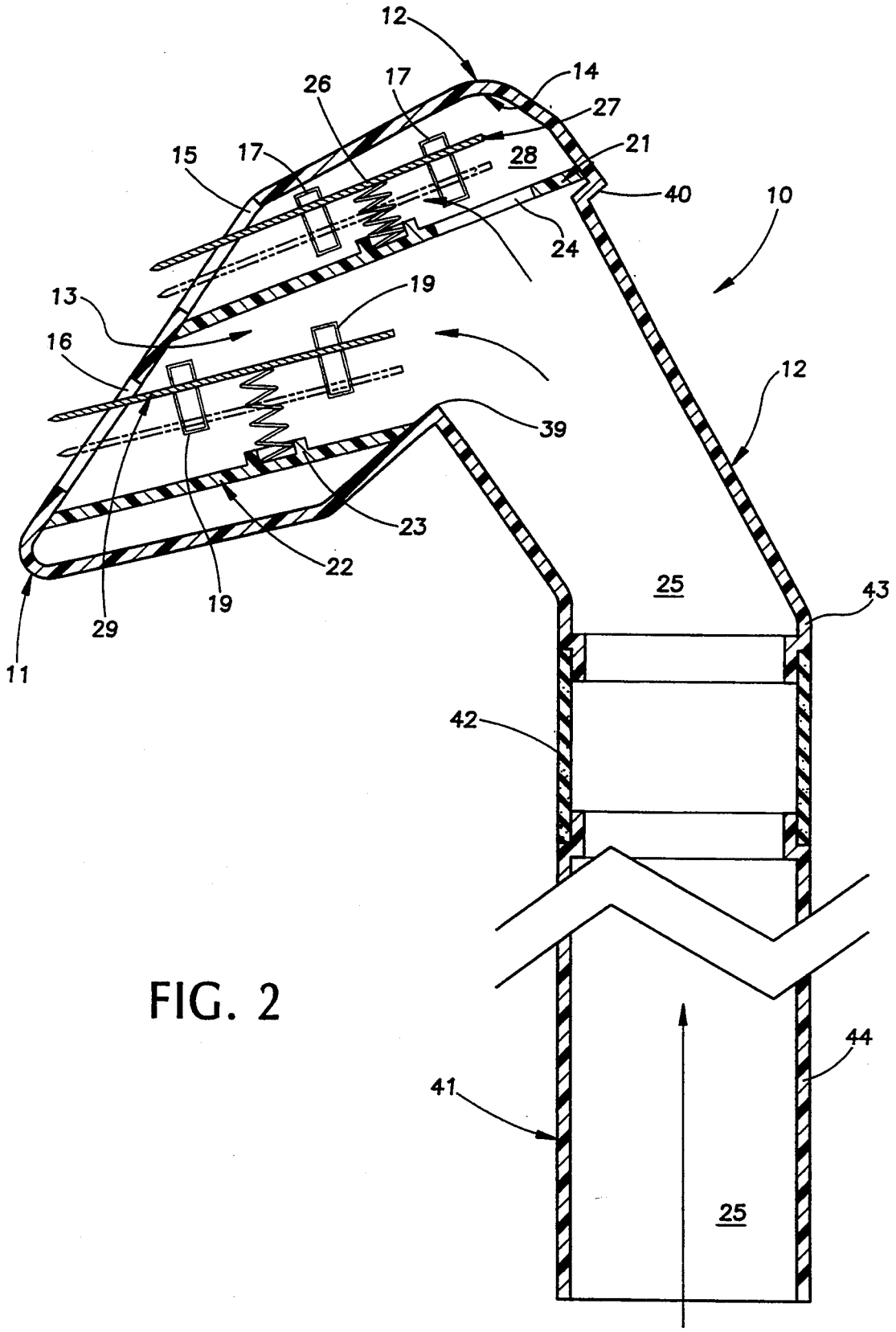
FIG. 2 is a cross-sectional view of the shaving apparatus taken along lines 2—2 and showing in a cross-sectional enlargement the flexible portion of the handle.
Figure 3:
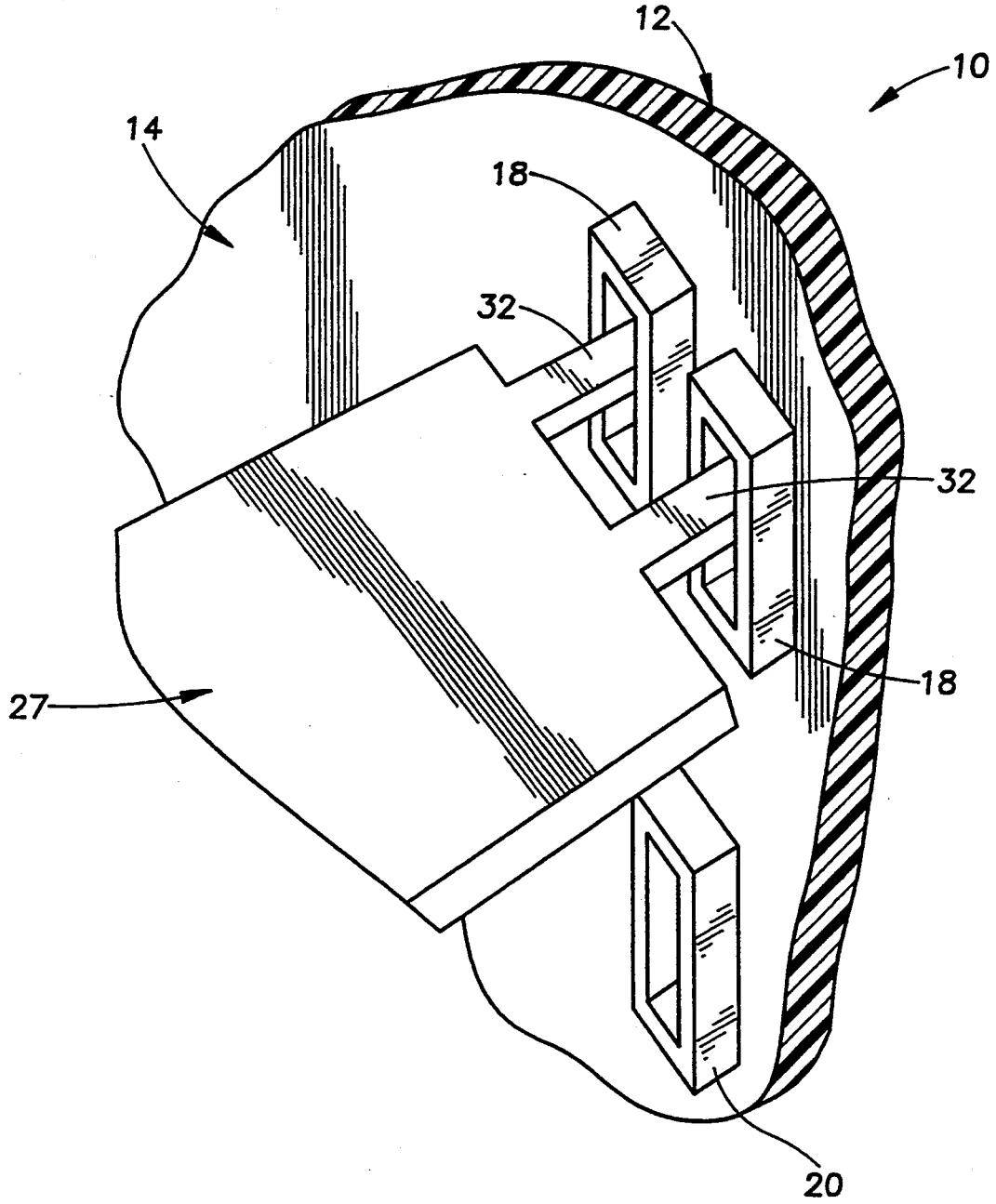
FIG. 3 is an enlarged partial cut-away perspective view showing the relationship of the blade tabs to the tab guides.
Figure 4:
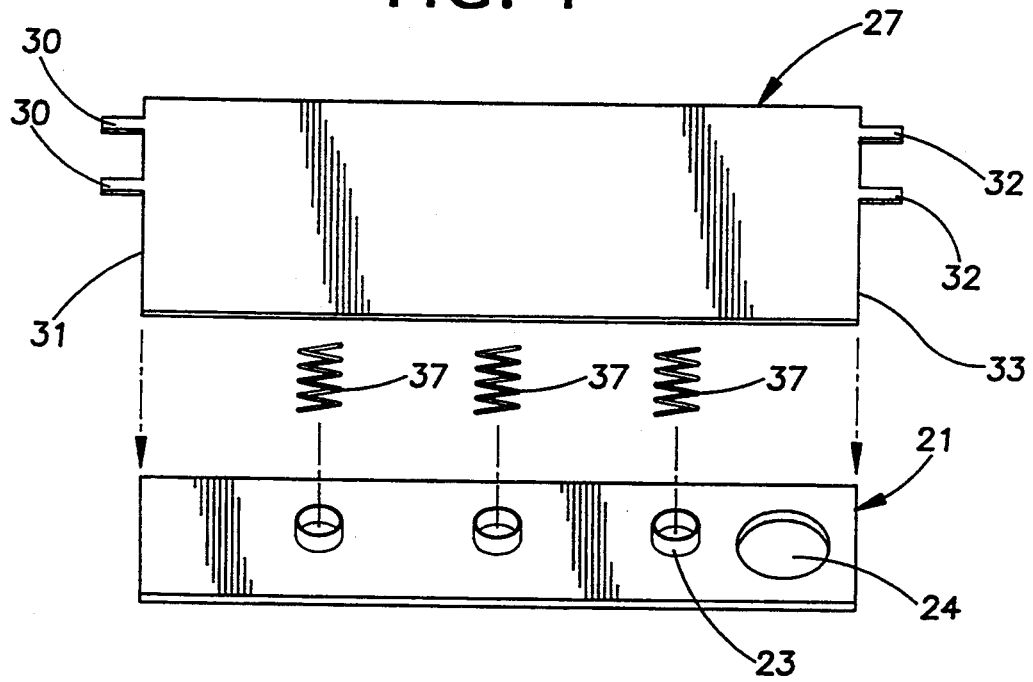
FIG. 4 is an enlarged exploded perspective view of an upper razor blade, springs and upper support member.

Referring to FIGS. 1 through 4, a shaving apparatus 10 is shown and described that has a shaver head 11 and a flexible handle 12. The shaver head 11 has a chamber 13 that has an enclosing wall 14. There is an upper blade port 15 and a lower blade port 16 cut or formed through the enclosing wall 14. There is a first pair of upper tab guides 17 and a second pair of upper tab guides 18 on the enclosing wall 14. There is a first pair of lower tab guides 19 and a second pair of lower tab guides 20 on the enclosing wall 14. The tab guides may be molded into the enclosing wall or attached by adhesives.

There is an upper support member 21 and a lower support member 22 attached to the enclosing wall 14. The upper and lower support members may be attached by adhesives, pinned in placed or heat sealed. Other ways are known in the art. There are three upper spring member retaining mounts 23 on the upper support member 21 and three lower spring member retaining mounts 39 on the lower support member 22. The upper support member 22 has a flow passage 24 therethrough to allow water (H2O) to flow from the handle flow passage 25 of the handle 12 past the upper support member 21 and out past the upper surface 26 of the upper razor blade 27 to clean out the shaving debris (not shown) of the upper surface 26 of the upper razor blade 27 and from the upper part 28 of the chamber 13 in the shaving head 11.

Figure 5:
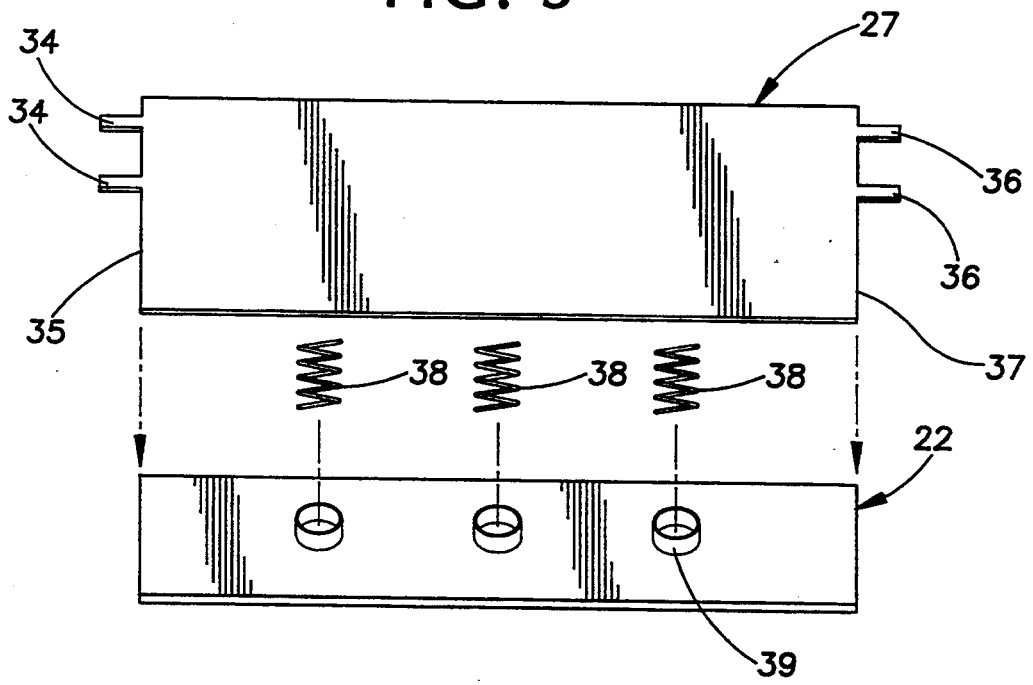
FIG. 5 is an enlarged exploded perspective view of a lower razor blade, springs and lower support member.

An upper razor blade 27 in the chamber 13 partially extends through the upper blade port 15 and a lower razor blade 29 in the chamber 13 partially extends through the lower blade port 16. The first pair of tabs 30, on a right side 31 the upper razor blade 27, are slidingly engaged in the first pair of the upper tab guides 17. The second pair of tabs 32, on a left side 33 of the upper razor blade 27, are slidingly engaged in the second pair of the upper tab guides 18 (see FIG. 4). There is a first pair of tabs 34, on a right side 35 the lower razor blade 29, that is slidingly engaged in the first pair of the lower tab guides 19. A second pair of tabs 36, on a left side 37 of the lower razor blade 27 (see FIG. 5), is slidingly engaged in the second pair of the lower tab guides 20. There is an upper spring 37 in each of the upper spring member retaining mounts 23 and a lower spring 38 in each of the lower spring member retaining mounts 39. The upper springs 37 abut the upper razor blade 27 and bias the upper razor blade 27 away from the upper support member 21. The lower springs 38 abut the lower razor blade 27 and bias the lower razor blade 27 away from the lower support member 22.

The shaver head 11 has a handle port 39 in the enclosing wall 14. The shaving apparatus 10 has a handle flexible 12. The handle 12 has an elongated gripping member 41 that has a flexible portion 42 connecting two nonflexible portions 43 and 44. There is a longitudinal passage 25 through the elongated gripping member 41 and the flexible portion 42 to allow the flow of water (H2O) through the handle 12 to the chamber 13 of the shaving head 12. The handle 12 is attached to the enclosure wall 14 around a periphery 40 of the handle port 39. The handle 12 may be formed as an integral part of the shaver head 11 by known molding methods or attached by a suitable adhesive.

Figure 6:
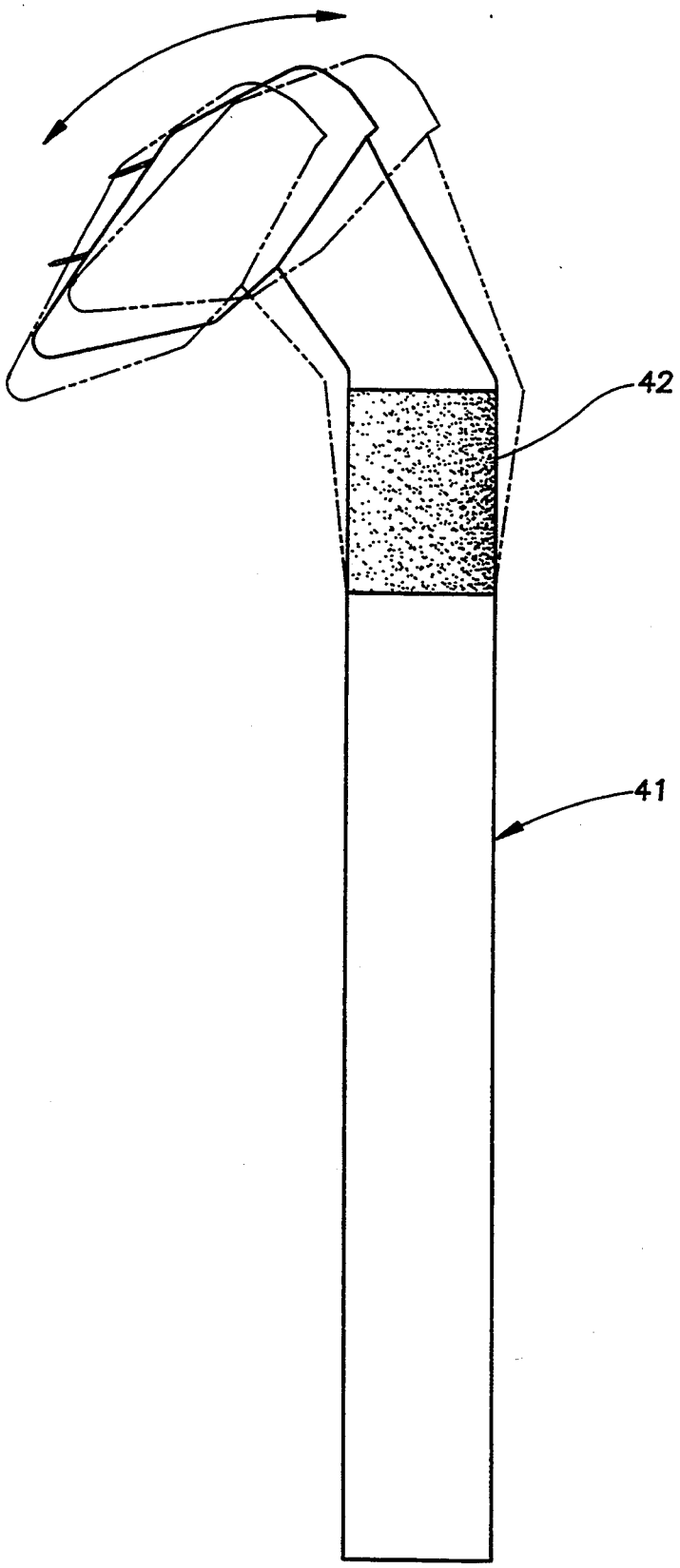
FIG. 6 is a left side elevational view of the shaving apparatus showing the flexibility of the handle allowing the shaver head to move in the manner indicated by the arrows.

As the blades are drawn across the skin of the user, the blades move up and down within the guides springingly restrained by the springs abutting their lower surface. The spring controlled and guided movement of the blades allows the blades to adjust to the irregularities of the shaving surface. The flushing features of the shaving apparatus help keep the blades clean of shaving debris and reduce the corrosion of the cutting edge of the blades. The flexible portion of the handle allows the user to more easily place the shaver head in the proper shaving position without placing the hand and wrist in an uncomfortable position. The added flexibility of the handle also allows the shaver head to ride more easily over the contours of the body while the user is shaving. This enhances the ability of the user to shave without nicks and cuts. The flexible portion is shown in FIG. 1 and 6 and in greater detail in FIG. 2. The flexible portion may be made of any suitable resilient and flexible material such as rubber or plastic and may be smooth or corrugated, among other configurations, in appearance. Attachment of the flexible member to the elongated gripping member may be by press fit or by suitable adhesives. The flexible member is preferably tubular to allow the passage of water therethrough.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A shaving apparatus comprising:

(a) a shaver head comprising:

a chamber having an enclosing wall;

a blade port through the enclosing wall;

a first pair of tab guides on the enclosing wall;

a second pair of tab guides on the enclosing wall;

a support member attached to the enclosing wall;

a biasing member retaining mount on the support member;

a razor blade in the chamber;

a first pair of tabs on a right side the razor blade engaged in the first pair of the tab guides;

a second pair of tabs on a left side of the razor blade engaged in the second pair of the tab guides;

a biasing member in the biasing member retaining mount;

the biasing member abutting the razor blade and biasing the razor blade away from the support member; and a handle port in the enclosing wall; and (b) a handle comprising:

a longitudinal passage therethrough; and the handle attached to the enclosure wall around a periphery of the handle port.

2. A shaving apparatus comprising:

(a) a shaver head comprising:

a chamber having an enclosing wall;

an upper blade port through the enclosing wall;

a lower blade port through the enclosing wall;

a first pair of upper tab guides on the enclosing wall;

a second pair of upper tab guides on the enclosing wall;

a first pair of lower tab guides on the enclosing wall;

a second pair of lower tab guides on the enclosing wall;

an upper support member attached to the enclosing wall;

a lower support member attached to the enclosing wall;

three upper biasing member retaining mounts on the upper support member;

three lower biasing member retaining mounts on the lower support member;

an upper razor blade in the chamber;

a lower razor blade in the chamber;

a first pair of tabs on a right side of the upper razor blade engaged in the first pair of the upper tab guides;

a second pair of tabs on a left side of the upper razor blade engaged in the second pair of upper tab guides;

a first pair of tabs on a right side of the lower razor blade engaged in the first pair of the lower tab guides;

a second pair of tabs on a left side of the lower razor blade engaged in the second pair of the lower tab guides;

an upper biasing member in each of the upper biasing member retaining mounts;

a lower biasing member in each of the lower biasing member retaining mounts;

the upper biasing member abutting the upper razor blade and biasing the upper razor blade away from the upper support member; the lower biasing member abutting the lower razor blade and biasing the lower razor blade away from the lower support member; and a handle port in the enclosing wall; and (b) a handle comprising:

an elongated gripping member having a flexible portion therein;

a longitudinal passage through the elongated gripping member and the flexible portion;

the elongated gripping member attached to the enclosure wall around a periphery of the handle port.

3. A shaving apparatus comprising:

(a) a shaver head comprising:

a chamber having an enclosing wall;

an upper blade port through the enclosing wall;

a lower blade port through the enclosing wall;

a first pair of upper tab guides on the enclosing wall;

a second pair of upper tab guides on the enclosing wall;

a first pair of lower tab guides on the enclosing wall;

a second pair of lower tab guides on the enclosing wall;

an upper support member attached to the enclosing wall;

a lower support member attached to the enclosing wall;

three upper spring member retaining mounts on the upper support member;

three lower spring member retaining mounts-on the lower support member;

an upper razor blade in the chamber partially extending through the upper blade port;

a lower razor blade in the chamber partially extending through the lower blade port;

a first pair of tabs on a right side the upper razor blade slidingly engaged in the first pair of the upper tab guides;

a second pair of tabs on a left side of the upper razor blade slidingly engaged in the second pair of the upper tab guides;

a first pair of tabs on a right side the lower razor blade slidingly engaged in the first pair of the lower tab guides;

a second pair of tabs on a left side of the lower razor blade slidingly engaged in the second pair of the lower tab guides;

an upper spring in each of the upper spring retaining mounts;

a lower spring in each of the lower spring member retaining mounts;

the upper springs abutting the upper razor blade and biasing the upper razor blade away from the upper support member; the lower springs abutting the lower razor blade and biasing the lower razor blade away from the lower support member; and a handle port in the enclosing wall; and (b) a handle comprising:

an elongated gripping member having a flexible portion therein;

a longitudinal passage through the elongated gripping member and the flexible portion;

the elongated gripping member attached to the enclosure wall around a periphery of the handle port.

* * * * *